US005845587A

United States Patent [19]

Ditonto

[11] Patent Number: 5,845,587

[45] Date of Patent: Dec. 8, 1998

[54] TWO-PART TABLE TOP

[75] Inventor: Alexander N. Ditonto, Jamestown, N.Y.

[73] Assignee: Signore, Incorporated, Ellicottville, N.Y.

[21] Appl. No.: 918,001

[22] Filed: Aug. 25, 1997

[51] Int. Cl.[6] ..... A47B 35/00

[52] U.S. Cl. ..... 108/50.01; 108/147

[58] Field of Search ..... 108/50.01, 3, 102, 108/138, 147, 147.11; 312/196, 223.2, 223.3; 248/917, 918, 919, 920

[56] References Cited

U.S. PATENT DOCUMENTS

| | | | |
|---|---|---|---|
| 4,852,500 | 8/1989 | Ryburg et al. | 108/50.01 X |
| 5,292,097 | 3/1994 | Russell . | |
| 5,322,025 | 6/1994 | Sherman et al. . | |
| 5,398,622 | 3/1995 | Lubinskas et al. | 108/3 X |
| 5,437,235 | 8/1995 | Randolph . | |
| 5,443,017 | 8/1995 | Wacker et al. | 108/3 |
| 5,461,974 | 10/1995 | Reneau | 108/50.01 X |
| 5,483,898 | 1/1996 | Seidl | 108/3 |
| 5,501,420 | 3/1996 | Watt et al. . | |
| 5,522,323 | 6/1996 | Richard . | |
| 5,526,756 | 6/1996 | Watson . | |
| 5,549,052 | 8/1996 | Hoffman | 108/138 X |
| 5,601,037 | 2/1997 | Meyer et al. | 108/147 |
| 5,685,510 | 11/1997 | Frankish | 108/147 X |

*Primary Examiner*—Jose V. Chen
*Attorney, Agent, or Firm*—Bean, Kauffman & Snyder

[57] ABSTRACT

A work station includes a work surface supported on a base via a pair of parallelogram linkages for vertical movement between upper and lower positions, while undergoing horizontal displacements towards and away from an operator; a monitor supporting surface mounted on the upper end of a standard having a lower end upstanding from the base. The work surface is formed with a through opening elongated in the direction of the horizontal displacements thereof, wherein parallel edges of the through opening slidably engage with the standard to constrain the work surface against horizontal movement transversely of the direction of its horizontal displacements.

12 Claims, 2 Drawing Sheets

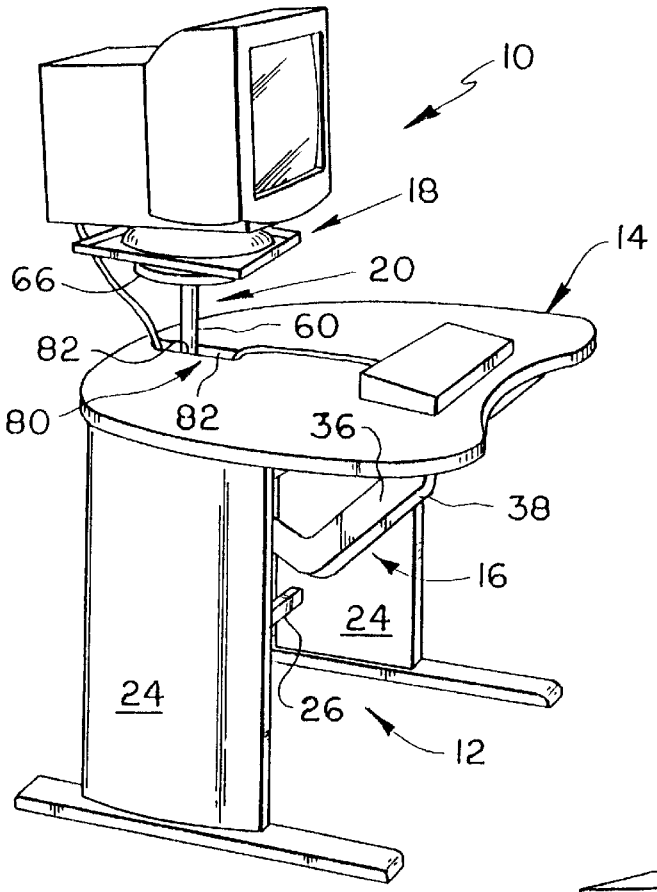
FIG. 1
FIG. 2
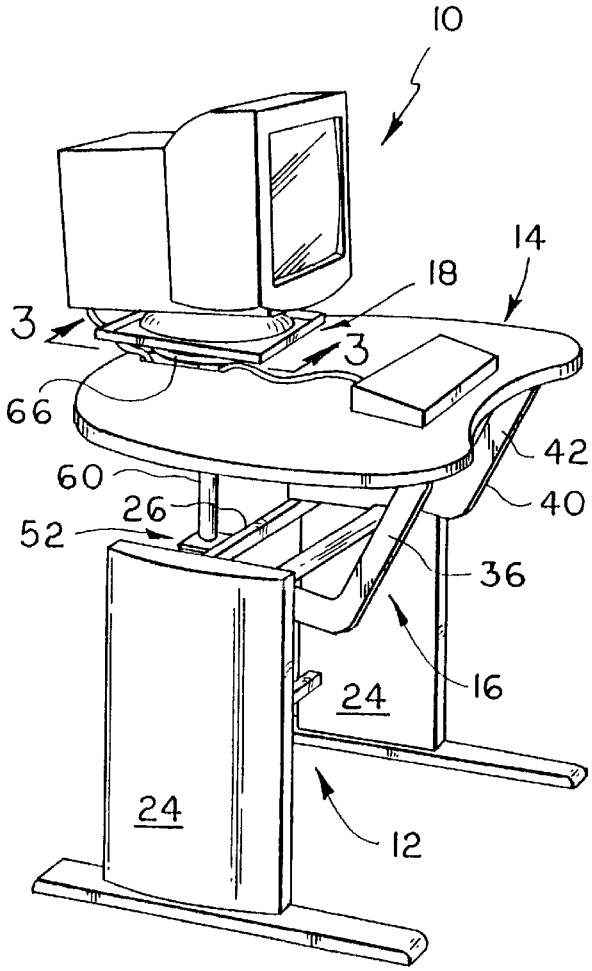
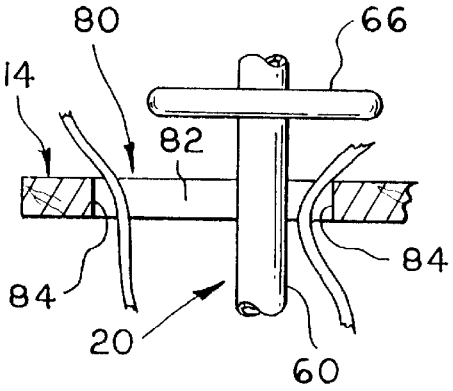
FIG. 3

TWO-PART TABLE TOP

BACKGROUND OF THE INVENTION

It is known to provide work stations at which a work surface and a monitor supporting surface are supported for independent movement both relative to a base and to each other. However, the relatively high cost of presently available units has restricted their use to large commercial offices and businesses.

Moreover, it is known to provide parallelogram-type linkage mechanisms to support a relatively small work surface, such as a keyboard support tray or the like for vertical movement relative to a suitable base or table. These mechanisms have not proven satisfactory for supporting large work surfaces, due to their tendency to permit sidewise directed movement of the work surface during use.

SUMMARY OF THE INVENTION

The present invention relates to a work station having a work surface and a monitor supporting surface independently supported for vertical movement relative to a base, and more particularly to a work station of the type described, which is adapted for relatively inexpensive construction by employing a known parallelogram linkage mechanism to support the work surface, and a standard to support the monitor supporting surface, wherein the standard additionally serves to stabilize the work surface against sidewise directed movement.

In a presently preferred form of the invention, a base is defined by a pair of pedestals transversely interconnected by a back portion; a parallelogram linkage mechanism including a pair of linkages arranged one on each of the pedestals and cooperating to support a work surface for vertical movement relative thereto; a monitor supporting surface; a vertically extending standard connected at its upper and lower ends to the monitor supporting surface and the back portion, respectively. The linkage mechanism is characterized as supporting the work surface for vertical movement between lower and upper positions, during which movement the work surface undergoes a limited degree of horizontal displacement towards and away from an operator.

The work surface is provided with a slot arranged in alignment with its direction of horizontal displacement and transversely sized to slidably engage with the monitor surface supporting standard, thereby to constrain the work surface against undesired sidewise movement extending transversely of the direction of horizontal displacement of the work surface.

BRIEF DESCRIPTION OF THE DRAWINGS

The nature and mode of operation of the present invention will now be more fully described in the following detailed description taken with the accompanying drawings wherein:

FIG. 1 is a prospective view of a work station formed in accordance with the present invention with its work surface disposed in a lowered position;

FIG. 2 is a view similar to FIG. 1, but showing the work surface in an elevated position;

FIG. 3 is a sectional view taken generally along the line 3—3 in FIG. 2;

DETAILED DESCRIPTION

Figure 4:
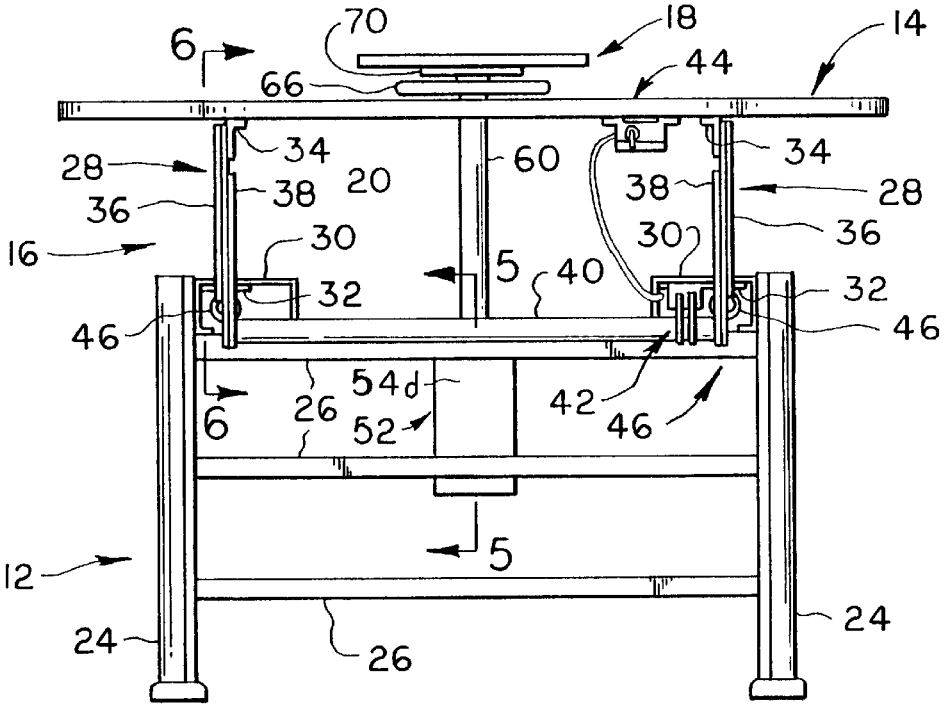
FIG. 4 is a front elevational view of the work station.

Reference is first made to FIGS. 1 and 2, wherein a work station formed in accordance with the present invention is generally designated as 10 and shown as comprising a base 12; an expansive work surface or table top 14 supported for vertical movement relative to the base by a parallelogram linkage mechanism 16; a monitor supporting surface or tray 18; and a standard 20 having its upper and lower ends connected to monitor supporting surface 18 and base 12, respectively.

Base 12 is best shown in FIG. 4 as comprising a pair of upstanding, floor mounted pedestals 24 and 24, which are interconnected by a horizontally extending back portion comprising for example, a plurality of parallel horizontally extending brace members 26,26 and 26.

Figure 6:
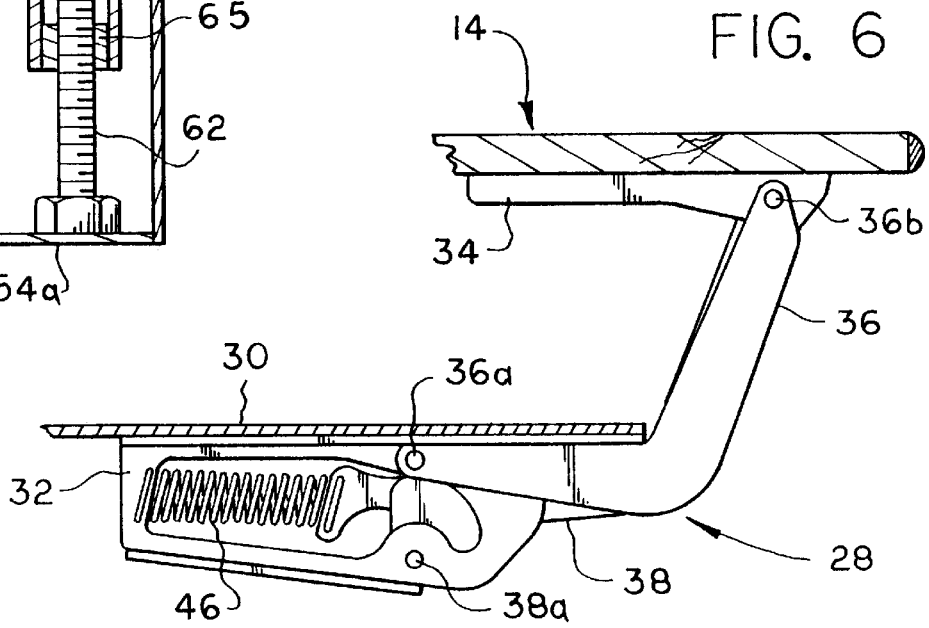
FIG. 6 is a sectional view taken generally along the line 6—6 in FIG. 4.

Mechanism 16 is best shown in FIGS. 4 and 6 as comprising a pair of parallelogram linkages 28 and 28 of like construction mounted one linkage on each of pedestals 24 and 24 via housings 30 and 30 fixed to the pedestals adjacent their upper ends. Each of linkages 28 and 28 generally includes a first mounting bracket 32 fixed within its associated housing 30; second mounting bracket 34 fixed to a lower or downwardly facing surface of work surface 14; a pair of links 36 and 38, which extend through the open front end of their associated housing 30 and have first ends pivotally connected to first mounting bracket 32 for relative movement about a first pair of parallel axes 36*a* and 38*a* extending horizontally and transversely of the pedestals and second ends pivotally connected to second mounting bracket 34 for relative movement about a second pair of parallel axes, only one of which is shown at 36*b*, disposed parallel to the first pair of axes; a tie bar 40 having its opposite ends rigidly fixed to links 36 and 36 or 38 and 38 for movement therewith; a locking or brake mechanism 42 controlled by a manually operable release mechanism 44 carried by work surface 14 for releasably retaining work surface 14 in a desired vertical position; and a pair of counterbalance springs 46, opposite end coupled to first mounting brackets 32 and one or the other of their associated links 36 and 38 for exerting a bias tending to at least partially counterbalance the weight of work surface 14.

It will be understood that linkage mechanisms 28 and 28 are commercial linkages of the type characterized in that work surface 14 is subject to rearward and forward directed horizontal movements relative to base 12 along a line parallel to pedestals 24 and 24, or normal to the first and second pairs of pivot axes of the linkage mechanisms, that is, away from and towards the operator of the work station incident to vertical movement of the work surface between the lower and upper positions shown in FIGS. 1 and 2, respectively. Typically, linkage mechanisms are constructed such that the work surface is maintained in some constant attitude, such as horizontal, throughout its range of vertical movement.

Linkage mechanisms of the type shown in the drawings are normally not rigid in a direction extending parallel to the pivot axes of their links 36 and 38, and therefore such mechanisms tend to permit limited sidewise movements of the work surface 14, that is, movements transversely of the direction of the above-mentioned horizontal movements of such work surface. In view of this characteristic sidewise movement, linkage mechanisms 28 and 28 would normally not be suitable for use in supporting a large work surface of the type depicted in the drawings.

Figure 5:
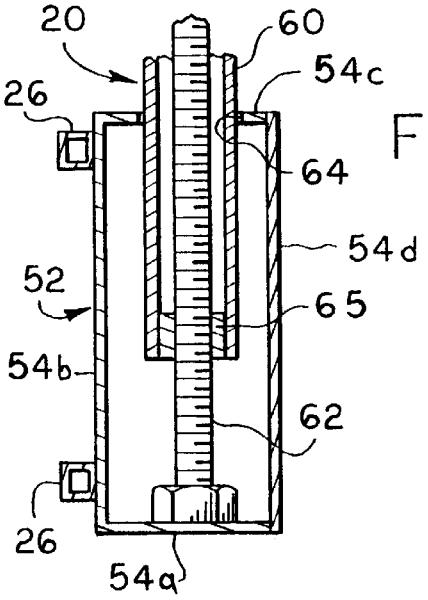
FIG. 5 is a sectional view taken generally along the line 5—5 in FIG. 4.

Standard 20 is mounted on the uppermost ones of base brace members 26 by a bracket or enclosure 52 having a lower support, upstanding mounting upper guide and front cover flange portions 54*a*, 54*b*, 54*c* and 54*d*, respectively. Standard 20 is best shown in FIGS. 4 and 5 as being defined by an elongated sleeve 60, which is selectively moveable vertically relative to base 12 for varying the height of monitor supporting surface 18 by an adjustment mechanism including a screw threaded rod 62 having a lower end fixed to lower support flange portion 54*a*, and arranged to extend vertically through a guide opening 64 formed in upper guide flange portion 54*c*; means, such as a pair of nuts only one of which is shown at 65 in FIG. 5 as being fixed internally of sleeve 60, for threadably coupling sleeve 60 to a rod 62; and a hand-operated adjustment wheel 66 rigidly fixed to the upper end of sleeve 60. Rotations of wheel 66 effects rotation of sleeve 66 relative to rod 62 as desired to move the sleeve axially of the rod, and thus vertically relative to base 12. Preferably, a bearing device 70 is employed to support monitor supporting surface 18 on sleeve 60 above hand wheel 66 in order to allow axial adjustments of the sleeve under the control of the hand wheel without causing rotation of the monitor supporting surface.

In accordance with the present invention, work surface 14 is provided with a guide means in the form of a vertically extending through guide opening 80 serving to define a pair of parallel guide edges or surfaces 82 and 82, which are spaced to loosely slidably engage with sleeve 60 to constrain work surface 14 against undesired sidewise movements extending transversely of the direction of horizontal displacements of the work surface relative to the sleeve occurring incident to vertical movements of the work surface between the lower and upper positions shown in FIGS. 1 and 2, respectively. In the illustrated construction, the ends 84 and 84 of guide opening 80 are closed and arranged such that they are spaced from engagement with sleeve 60 when the work surface is moved into its extreme vertical positions shown in FIGS. 1 and 2. This requires the provision of means, not shown, associated for example, with linkages 28 and 28 to define the permitted range of movement of work surface 14. Alternatively, for example, engagement of work surface 14 with the upper ends of standards 24 and 24 may be relied upon to define the lowermost portion of work surface or engagement of sleeve 60 with the ends of slot 80 may be employed to define the limit of vertical travel of the work surface.

What is claimed is:

1. A work station comprising in combination:

a work surface;

a monitor supporting surface;

a work station supporting base;

means for supporting said work surface directly to said base for vertical movement relative thereto between lower and upper positions; and a standard having a lower end mounted directly to said base and an upper end for mounting said monitor supporting surface, said work surface being arranged to slidably engage with said standard independently of said means for supporting said work surface during vertical movement of said work surface relative to said base for stabilizing said work surface.

2. A work station according to claim 1, wherein adjustment means are provided to adjust the vertical position of said monitor supporting surface relative to said base independently of said work surface.

3. A work station according to claim 1, wherein said means for supporting said work surface includes a parallelogram linkage mechanism characterized as supporting said work surface for back and forth movement in a given horizontal direction incident to said vertical movement of said work surface back and forth between said lower and upper positions, and said standard and said work surface slidably engage for constraining said work surface against movement transversely of said given horizontal direction.

4. A work station according to claim 3, wherein said work surface is formed with a vertically extending, through guide opening for slidably receiving said standard.

5. A work station according to claim 1, wherein said base has a pair of upstanding, horizontally spaced pedestals interconnected by a horizontally extending back portion; said means for supporting said work surface includes a pair of parallelogram linkages arranged in parallel and mounted one linkage on each of said pedestals; and said lower end of said standard is mounted on said back portion.

6. A work station according to claim 5, wherein adjustment means are provided to adjust the vertical position of said monitor supporting surface relative to said back portion independently of said work surface.

7. A work station according to claim 5, wherein said work surface is formed with guide means extending parallel to said linkages and arranged for slidable engagement with said standard during said vertical movement of said work surface.

8. A work station according to claim 5, wherein said linkages are characterized as supporting said work surface in an essentially constant attitude during movement thereof back and forth between said lower and upper positions, while causing back and forth movement of said work surface in a horizontal direction extending essentially parallel to said linkages; and said work surface has guide means extending parallel to said horizontal direction and arranged to slidably engage with said standard, thereby to constrain said work surface against horizontal movement transversely of said horizontal direction.

9. A work station according to claim 8, wherein said guide means is defined by facing edges of a guide opening extending vertically through said work surface and said edges being elongated in alignment with said horizontal direction.

10. A work station according to claim 9, wherein adjustment means are provided to adjust the vertical position of said monitor supporting surface relative to said back portion independently of said work surface.

11. A work station according to claim 10, wherein said standard includes a sleeve having upper and lower ends, a vertically extending screw threaded rod having a lower end portion fixed to said base, said sleeve being disposed concentrically of said rod and threadably connected thereto, whereby said upper end of said sleeve is displaced vertically relative to said base upon rotation of said sleeve relative to said rod, a manual adjustment wheel fixed for rotation with said upper end of said sleeve, and bearing means for mounting said monitor support surface on and for free rotational movement relative to said sleeve about an axis extending in alignment with said rod.

12. A work station according to claim 1, wherein said standard includes a sleeve having upper and lower ends, a vertically extending screw threaded rod having a lower end portion fixed to said base, said sleeve being disposed concentrically of said rod and threadably connected thereto, whereby said upper end of said sleeve is disposed vertically above said work surface and displaced vertically relative to said base upon rotation of said sleeve relative to said rod, a manual adjustment wheel fixed to and for rotation with said upper end of said sleeve, said work surface slidably engages with said sleeve intermediate said upper and lower ends, and bearing means for mounting said monitor support surface on and for free rotational movement relative to said sleeve about an axis extending in alignment with said rod.

* * * * *